United States Patent [19]

Buunk et al.

[11] 4,215,456

[45] Aug. 5, 1980

[54] METHOD OF MANUFACTURING AN ELECTRIC LAMP

[75] Inventors: Jan R. Buunk; Bernardus M. A. Dorsemagen; Johannes G. H. Van Dijkman, all of Eindhoven, Netherlands

[73] Assignee: U.S. Philips Corporation, New York, N.Y.

[21] Appl. No.: 934,825

[22] Filed: Aug. 18, 1978

[30] Foreign Application Priority Data

Sep. 23, 1977 [NL] Netherlands ..... 7710409

[51] Int. Cl.[2] ..... H01J 9/18

[52] U.S. Cl. ..... 29/25.13; 29/433; 313/318; 339/146

[58] Field of Search ..... 339/144 R, 146 R; 313/318; 140/71.5, 71.6; 29/25.13, 25.15, 25.16, 241, 25.19, 433

[56] References Cited

U.S. PATENT DOCUMENTS

| | | | |
|---|---|---|---|
| 2,736,873 | 2/1956 | Bechard | 339/146 |
| 2,748,450 | 6/1956 | Flaws | 29/25.13 |
| 3,286,218 | 11/1966 | Wright | 313/318 UX |
| 3,629,640 | 12/1971 | Audesse | 313/318 |
| 3,739,221 | 6/1973 | De Bleyker | 313/318 |
| 3,775,634 | 11/1973 | Hasell | 339/146 X |

FOREIGN PATENT DOCUMENTS 1431275 4/1976 United Kingdom .

*Primary Examiner*—Howard N. Goldberg
*Assistant Examiner*—John S. Brown
*Attorney, Agent, or Firm*—Robert S. Smith

[57] ABSTRACT

In manufacturing an electric lamp having at least one current supply wire connected to a lamp cap after having been passed through an aperture in the cap, the end of the wire is guided through the aperture after folding back the free end of the wire to provide a rounded surface which does not snag. Preferably the wire is folded back at a predetermined distance from its point of emergence from the lamp envelope, thereby eliminating the need for snipping off the excess length.

3 Claims, 8 Drawing Figures

METHOD OF MANUFACTURING AN ELECTRIC LAMP

Figures 1A, 1B, 1C, 1D, 1E, 1F:
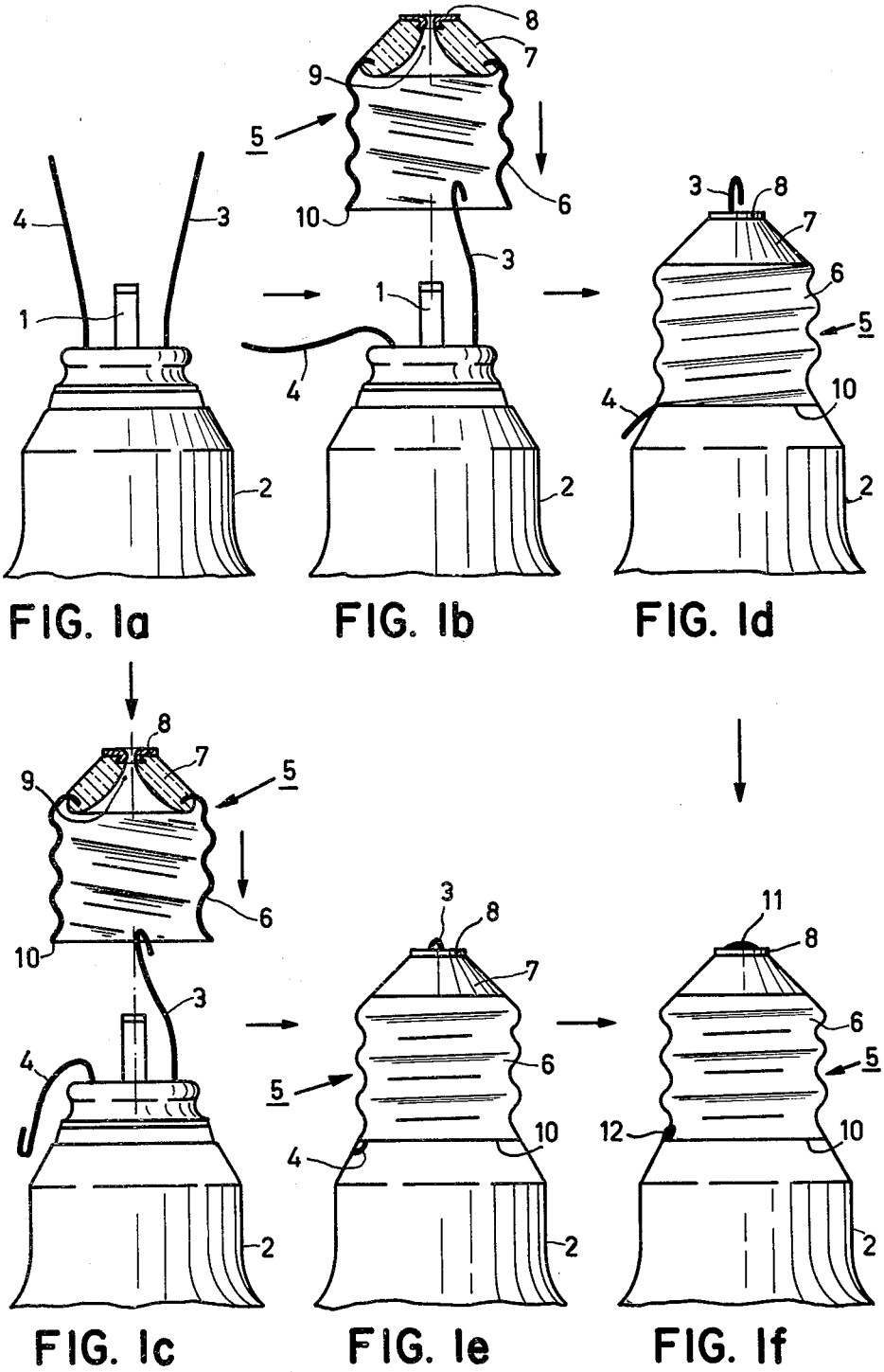

The invention relates to a method of manufacturing an electric lamp having a light-pervious lamp envelope in which an electric light-generating element is accommodated from which current supply wires pass through the wall of the lamp envelope in a vacuum-tight manner, the lamp envelope being provided with a lamp cap and at least one of the current supply wires being passed through an aperture in the lamp cap and being then connected to the lamp cap near said aperture.

The lamp manufactured according to this method may be either an incandescent lamp, in which case the electric element is a filament, or a gas discharge lamp, in which case the electric element is a pair of electrodes—surrounded or not surrounded by a discharge envelope.

A method of the kind mentioned in the preamble is disclosed in Netherlands Pat. No. 113,094 in which the current supply wire is passed through the aperture in the lamp cap by means of a hollow needle. Said needle is inserted through the aperture in the lamp cap and slid over the current supply wire. The lamp cap is then moved over the needle towards the lamp envelope and the hollow needle is then retracted. In order to be able to perform said method, tongs are necessary which align the current supply wire and the needle with respect to each other. Not only is the performance of the known method very time-consuming, but it also requires complicated machines.

In alternative methods of passing the current supply wire through the aperture in the lamp cap, either the lamp cap or the lamp envelope with the current supply wire is vibrated.

It is the object of the invention to provide a method in which the current supply wire is simply and reliably passed through the aperture in the lamp cap upon assembling the lamp cap on the lamp envelope.

In agreement herewith the invention relates to a method of the kind mentioned in the preamble which is characterized in that the current supply wire is folded back on itself at its free end and is then threaded through the aperture in the lamp cap.

It has been found that a folded current supply wire easily slides through the aperture in the lamp cap even without being aligned with respect to said aperture. This is presumably caused by the fact that the tip of the wire is formed in this case by a smooth curve, whereas the tip of a straight wire comprises sharp burrs which result from cutting or clipping the wire from a wire of a larger length. The fold in the folded current supply wire, however, is preferably previously located on an imaginary straight line which, when the lamp cap and the lamp envelope are arranged to be coaxial, extends parallel to the axis of the lamp envelope and passes through the aperture in the lamp cap.

In a particular embodiment of the method the current supply wire is folded to a predetermined length, that is to say at such a distance from the lamp envelope that the wire, after having been threaded through the aperture in the lamp cap, does not have to be shortened. This in contrast with the current production methods.

The elimination of the shortening of the current supply wire is important since the cutting a wire leaves many short lengths of wire which causes extra machine maintenance. Furthermore, if a wire has to be shortened, it should be checked whether said operation has in fact taken place and whether the clipped-off part has in fact been removed.

In the manufacture of lamps in which a second current supply wire is passed between the lamp envelope and the edge of the lamp cap to project outside the lamp cap and is connected to said cap, the end of said wire may also be similarly folded to length. This presents the advantage the second wire also does not have to be cut off. This cutting off would otherwise be necessary to prevent the wire end from extending partly along the lamp envelope causing the lamp, when being placed in a lamp holder, from being unsafe to touch.

The invention also relates to an electric lamp having a light-pervious lamp envelope in which an electric light-generating element is accommodated from which current supply wires pass through the wall of the lamp envelope in a vacuum-tight manner, which lamp envelope has a lamp cap having at least one aperture through which one of the current supply wires extends and near which aperture said current supply wire is connected to the lamp cap, characterized in that the current supply wire which extends through the aperture in the lamp cap is folded back on itself at the area of connection to the lamp cap.

A particular embodiment of such a lamp in which a second current supply wire projects from the lamp cap between the lamp envelope and the adjacent edge of the lamp cap and is there connected to the cap is characterized in that the free end of the second current supply wire is also folded back on itself at the area of connection to the lamp cap.

The advantage of these lamps is that they can be manufactured more easily and more rapidly. Furthermore they are more safe in use.

Figure 2:
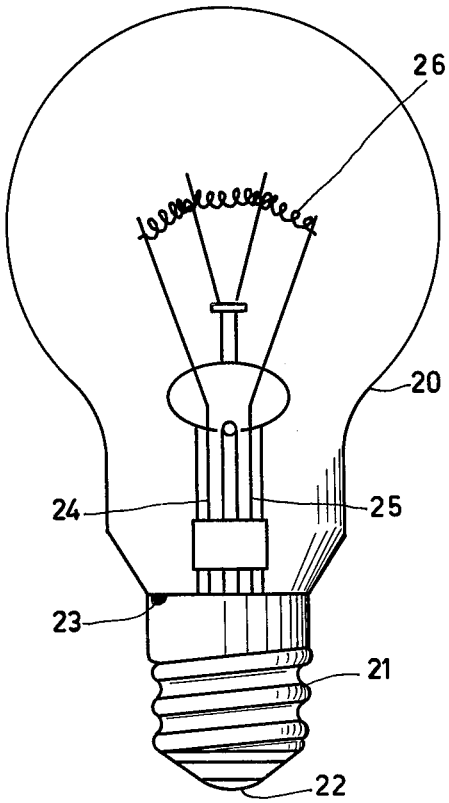
Figure 3:
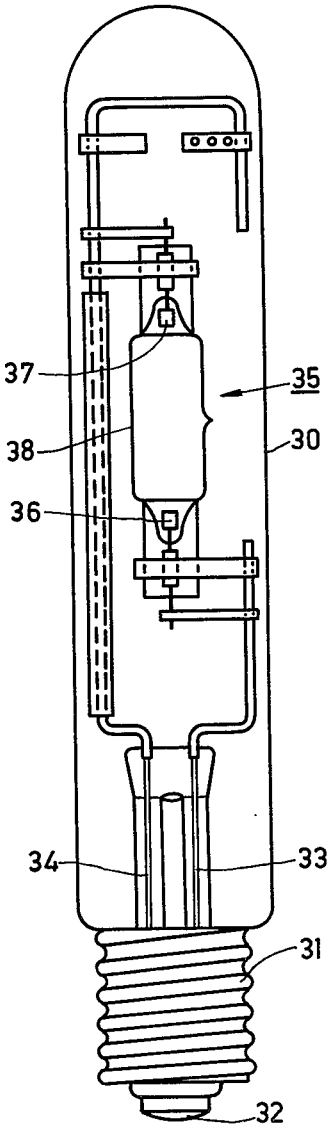

Embodiments of the invention will now be explained in detail by way of example, with reference to the accompanying drawings, of which:

FIGS. 1*a* to 1*f* show various stages of the manufacture of electric lamps according to the invention, and FIGS. 2 and 3 are elevations of lamps according to the invention.

FIG. 1*a* is an elevation of the bottom portion of a lamp after the exhaust tube 1 of the lamp envelope 2 has been sealed. 3 and 4 denote current supply wires which pass through the wall of the lamp in a vacuum-tight manner.

In FIG. 1*b* the current supply wire 3 is folded back at its free end. The Figure also shows a cross-sectional view of a lamp cap 5. The lamp cap in this case consists of a metal Edison screw cap 6 which is connected to a metal base contact plate 8 by means of a glass member 7. An aperture 9 is provided in the lamp cap. In this stage the lamp cap is lowered on to the lamp the current supply wire 3 passing through the aperture 9 and the current supply wire 4 projecting between the edge 10 of the lamp cap and the lamp envelope 2.

In FIG. 1*c* the current supply wire 3 and 4 are folded to a predetermined length. The fold in wires is situated on the center line of the lamp.

In FIG. 1*e* the lamp cap has been placed on the lamp envelope. The folded supply wires 3 and 4 project just beyond the lamp cap.

In FIG. 1*f* the lamp of FIG. 1*e* is shown with the current supply wires 3 and 4 secured to the lamp cap at 11 and 12, respectively, for example by soldering.

In FIG. 1*d* the lamp cap 5 of FIG. 1*b* has been placed on the lamp envelope 2 without using the step shown in FIG. 1*c* and so the current supply wires 3 and 4 have still to be shortened. FIG. 1*f* shows the lamp after the supply wires have been shortened by clipping and connected to the cap 5 by soldering.

Reference numeral 20 in FIG. 2 denotes the transparent lamp envelope of an incandescent lamp having a lamp cap 21 comprising a bottom contact 22. A current supply wire 24 is connected to the lamp cap at one end at 23 and is connected at the other end to a filament 26. A current supply wire 25 extends from the filament 26 to the bottom contact 22. Prior to their connection to the lamp cap 21, the free ends of the current supply wires 24 and 25 are folded in the manner shown in FIG. 1. The folded ends will be visible when the solder at 22 and 23 is removed.

FIG. 3 shows a high-pressure mercury vapour discharge lamp having a lamp envelope 30 and a lamp cap 31 having a bottom contact 32 to which a current supply wire 33 is connected. Current supply wire 34 is connected to the side wall of the lamp cap 31. Arranged in the lamp envelope is an electric element 35 consisting of electrodes 36 and 37 which are surrounded by a discharge vessel 38 having an ionizable gas filling.

What is claimed is:

1. A method of manufacturing an electric lamp which comprises: providing a light-pervious lamp envelope having an electric light generating element disposed therein and at least one current supply wire fixed to the element, providing the lamp envelope with a lamp cap having an aperture, folding the one wire back on itself at its free end, then threading the one wire through the aperture in the lamp cap, connecting the one wire to the lamp cap near the aperture.

2. A method as claimed in claim 1 wherein the one current supply wire is folded to a predetermined length.

3. A method as claimed in claim 2 wherein the step of providing the envelope includes providing a second current supply wire fixed to the element and further including the step of inserting the second current supply wire intermediate the lamp cap and the lamp envelope and then connecting the second current supply wire to the cap after folding the free end of the second current supply wire back to a predetermined length.

* * * * *